US006185795B1

(12) United States Patent
Shui-Shang

(10) Patent No.: US 6,185,795 B1
(45) Date of Patent: Feb. 13, 2001

(54) CLIP MECHANISM

(76) Inventor: Chen Shui-Shang, 199, Su Mou Road, Ho Mei Township, Chan Hua Hsien (TW)

( * ) Notice: Under 35 U.S.C. 154(b), the term of this patent shall be extended for 0 days.

(21) Appl. No.: 09/294,130

(22) Filed: Apr. 19, 1999

Related U.S. Application Data

(63) Continuation-in-part of application No. 09/031,117, filed on Feb. 26, 1998, now Pat. No. 6,023,818.

(51) Int. Cl.[7] ..... A44B 21/00
(52) U.S. Cl. ..... 24/507; 24/510; 24/DIG. 22
(58) Field of Search ..... 269/261, 263, 269/283, 258, 275, 281, 284; 81/423, 424, 302; 24/510, 511, 551–554, DIG. 22, 507, 521, 561, 562, 564

(56) References Cited

U.S. PATENT DOCUMENTS 150,900 * 5/1874 Silver et al. .
622,197 * 4/1899 Bayles et al. .
803,668 * 11/1905 Clendenon .
1,281,913 * 10/1918 Curley .
3,269,766 * 8/1966 Gardner .
3,383,963 * 5/1968 Vondrachek .
3,930,329 * 1/1976 Burkhardt .
4,616,113 * 10/1986 Jank et al. .
5,022,291 * 6/1991 McBain .
5,791,210 * 8/1998 Wolff et al. .
5,876,026 * 3/1999 Chen .
6,023,818 * 2/2000 Shang .

* cited by examiner

*Primary Examiner*—James R. Brittain
(74) *Attorney, Agent, or Firm*—Harrison & Egbert

(57) ABSTRACT

An improved clip mechanism in which a revolve arm spring is fastened at the center of two relative handles providing the two revolve arms are expanded to the inner side of each handle, so as to enable the front edge of the two handles having a force in clamping. In addition, inside the front edge of each handle is formed relatively a proper plain area contacting with each other. The plain area is formed an inner concave, which is protruded with a pillar. The head of the pillar is expanded to be a big edge, so as to enable the protrusion surface of clip plate to embed into the pillar of inner concave.

1 Claim, 5 Drawing Sheets

CLIP MECHANISM

RELATED APPLICATIONS

The present application is a continuation-in-part of U.S. patent application Ser. No. 09/031,117, filed on Feb. 26, 1998, and entitled "Spring-Biased Clothespin", now U.S. Pat. No. 6,023,818.

FIELD OF THE INVENTION

The present invention relates generally to a clip, and more particularly to an improved clip mechanism.

BACKGROUND OF THE INVENTION

As shown in FIG. 1, the conventional clip 10 is provided with two arms 11, from the revolve arm spring 12 to clamp. However, since the forward clamping portion of arms 11 of the clip 10 is constructed integral with a small forward end 13, it therefore causes the clip 10 to not clamp securely the outer surface of the article. Often, the clip 10 fails in clamping because the area of forward end 13 is small.

SUMMARY OF THE INVENTION

The primary objective of the present invention is therefore to provide an improved clip mechanism wherein the forward end of the clip is provided each with a clip plate that can with stand the clamping force, so that the present invention achieves more security in clamping the particular article clamped between the arms.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
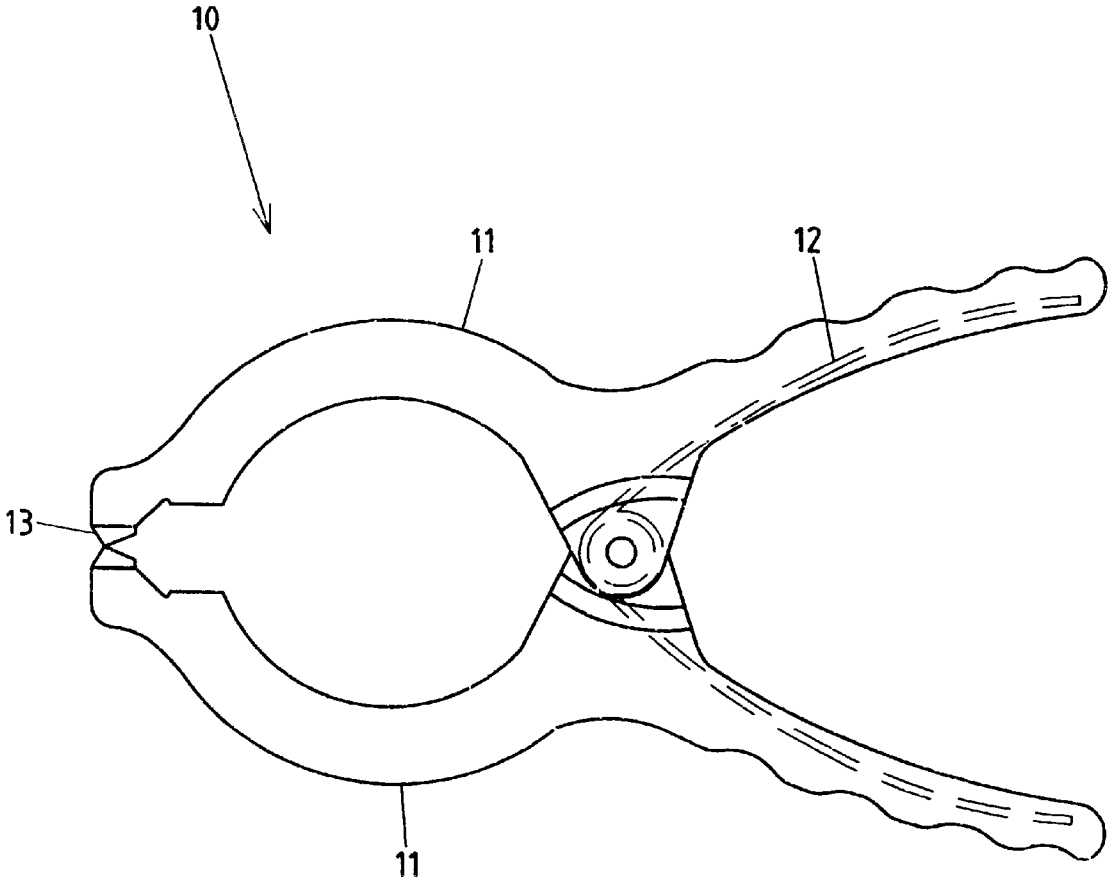
FIG. 1 PRIOR ART
FIG. 1 shows a schematic plan view of the prior art clip.
Figure 2:
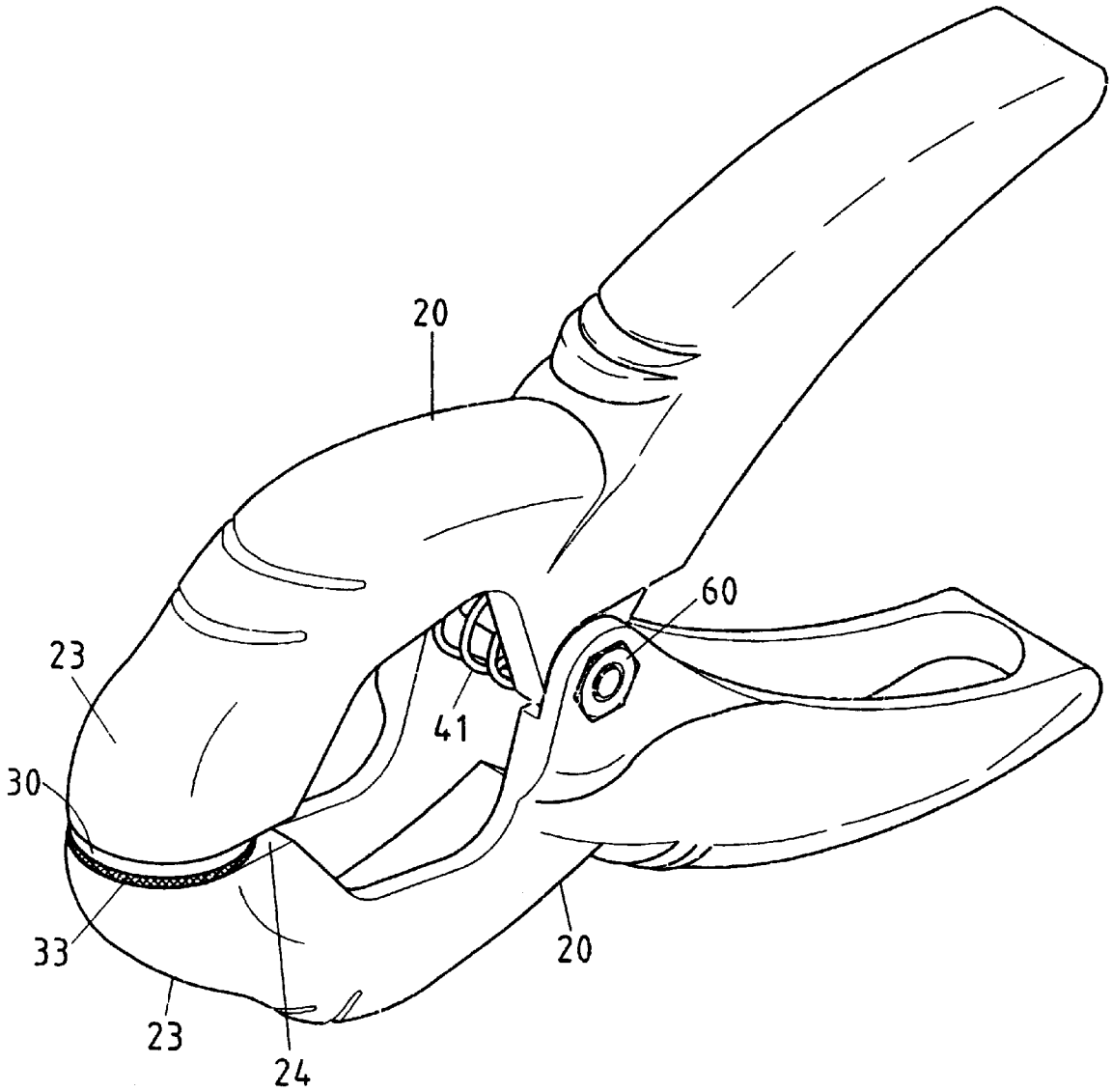
FIG. 2 shows a perspective view of the present invention.
Figure 3:
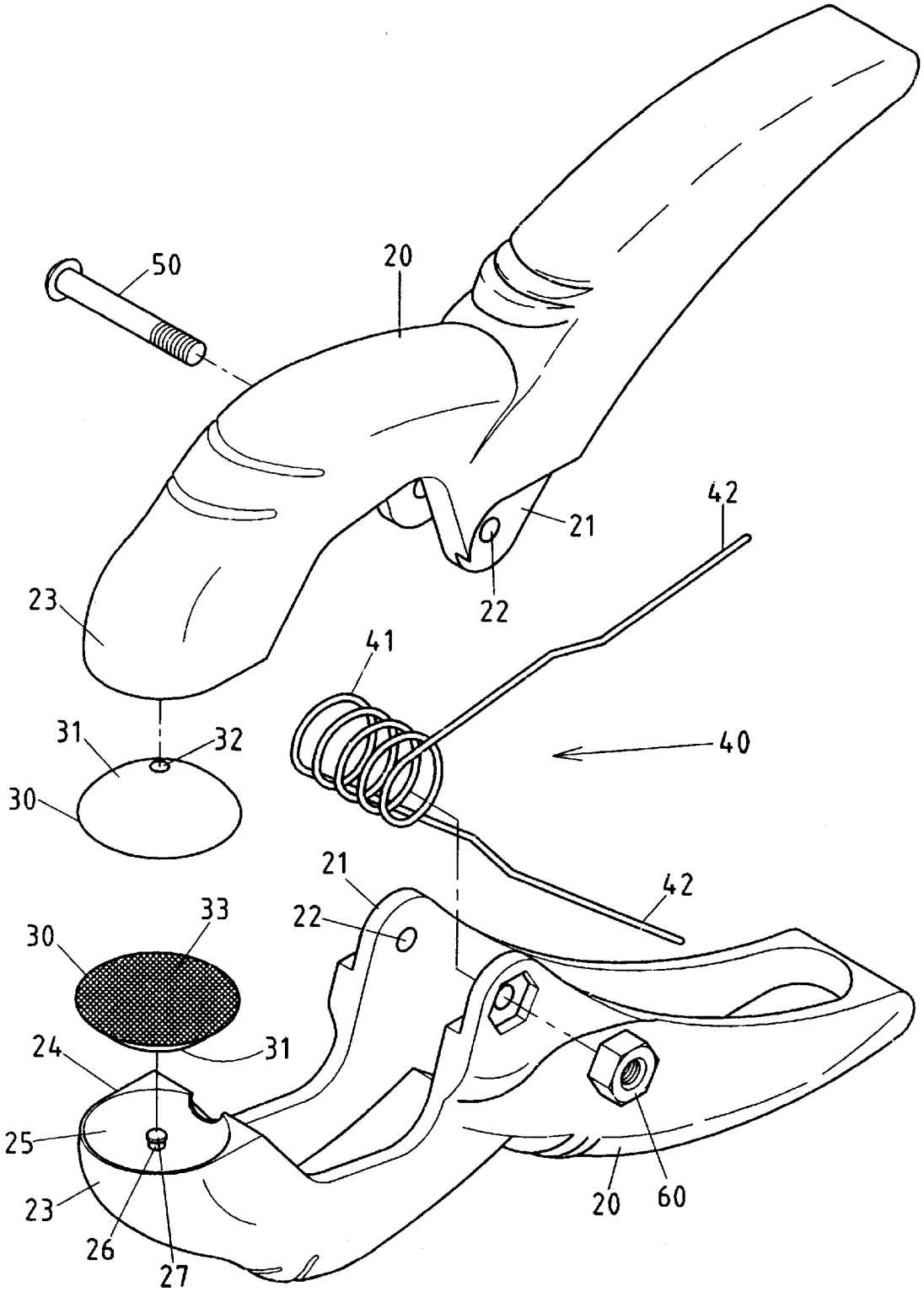
FIG. 3 shows an exploded view of the present invention.

As shown in FIGS. 2 and 3, the present invention is an improved clip device which is comprised of two arms 20, two clip plates 30, a leaf spring 40, and a bolt 50.

The two arms 20 are provided each with projection piece 21 at the center. Each projection piece 21 has a hole 22 aligned with to each other. In addition, inside the forward end 23 of each arm 20 is formed a rather large surface area 24. The surface area 24 is formed with an inner concave 25, which has a vertical pillar 26 extending transversely outwardly therefrom. The vertical pillar 26 has a bulbous head 27 opposite concave 25.

The two clip plates 30 are positioned respectively within and against the inner concave 25 of forward end 23 of arm 20. One surface of the clip plate 30 that faces the inner concave 25 of forward end 23 has a concave surface 31, which is provided at the center with an aperture 32 for receiving the bulbous head 27 of vertical pillar 26. Each convex surface 31 of clip plate 30 maintains a proper spacing from the inner concave 25 of forward end 23 of arm 20. The other surface of clip plate 30 is formed with a plurality of gripping ribs 33.

The leaf 40 has a spiral section 41 positioned between the projection pieces 21 the spring 40 is positioned between the arms 20 with the spiral section 41 at the center of the arms 20. Two leaf spring arms 42 extend along respective inner surfaces of the handle portions of arms 20.

The bolt 50 passes through the hole 22 of center projection pieces 21 of arms 20 and is fastened with a nut 60, so that the center of arms 20 are fastened pivotally. The leaf spring arms 42 of leaf spring 40 urges the arms 20 away from each other such that the pivoting about bolt 50 causes the clamping action of the arms 20.

Figure 4:
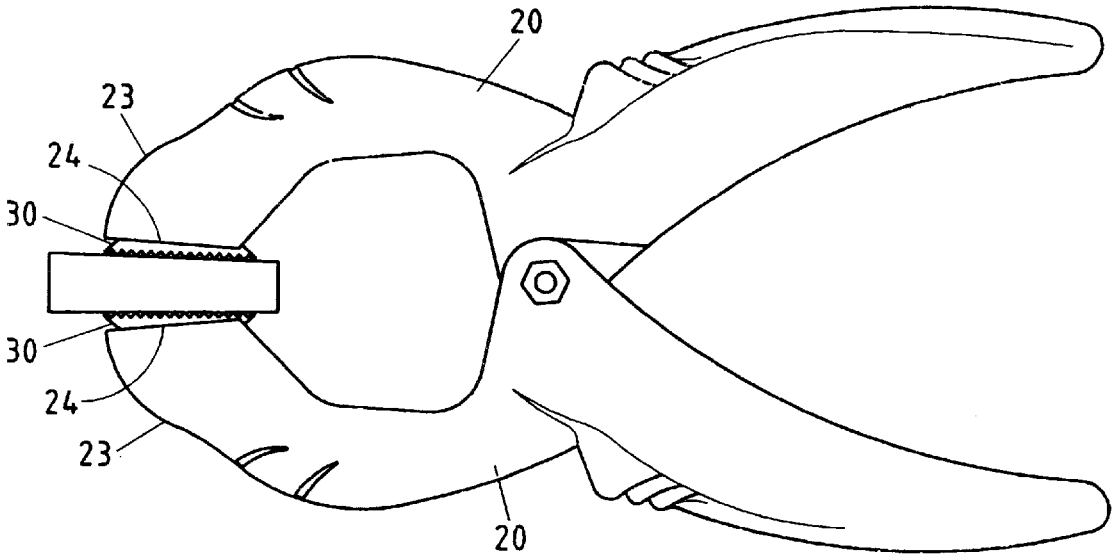
FIG. 4 shows a sectional view of the present invention as shown while clamping an article.
Figure 5:
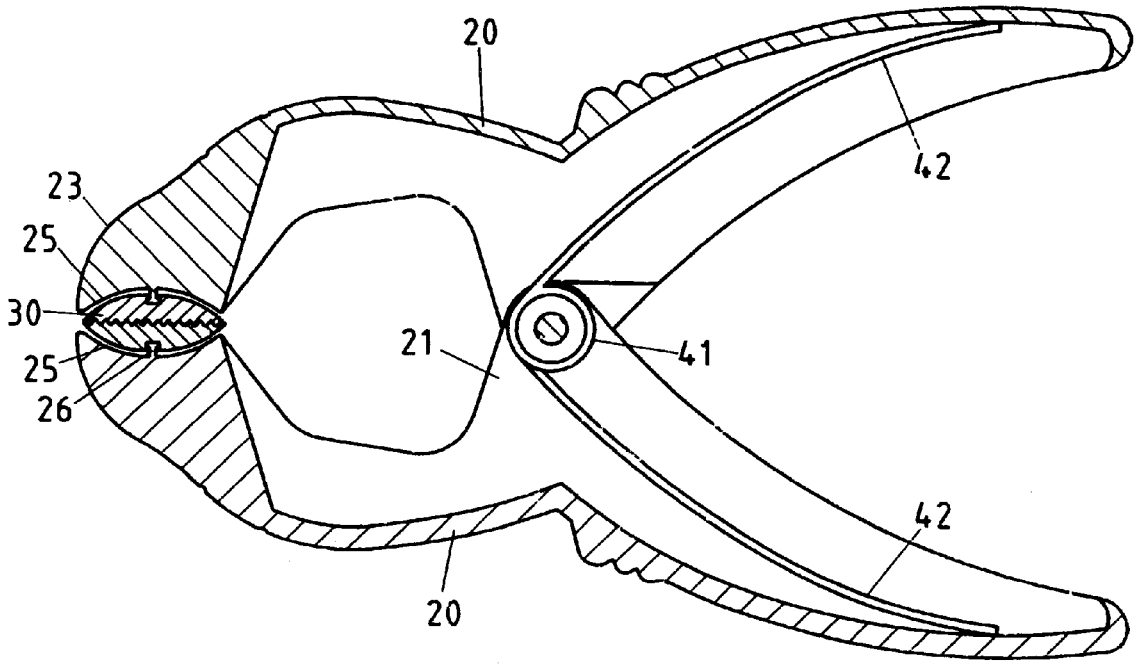
FIG. 5 shows a schematic plan view of the present invention.

As illustrated in FIGS. 4 and 5, when the present invention needs to clamp an uneven or a non uniformaly shape article, the clip plates 30 will cant or pivot relative to the inner concave 25 at the forward end 23 of respective arms 20 so as to fixedly clamp onto the uneven article. Furthermore, each clip plate 30 is provided with the gripping ribs 33 so as to prevent the uneven article from sliding from between the clip pates 30 present invention can clamp securely clamp the article. In addition, the convex surface 31 of clip plate 30 keeps a proper the inner concave 25 of forward end 23 of arm 20. Each center of clip plate 30 is pivotally mounted on the pillar 26 forming a center support fulcrum. The pivoting and canting of the clip plates 30 causes the article to be clamped firmly and securely.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. An improved clip mechanism comprising:

a pair of arms each having a projection piece extending inwardly at a center thereof, said projection piece of one arm having a hole aligned with a hole on said projection piece of the other arm, each of said pair of arms having an area at a forward end thereof, the area at the forward end of one arm contactable with the area at the forward end of the other arm, said area having an inner concave formed therein, said inner concave having a pillar extending centrally and transversely outwardly therefrom, said pillar having a bulbous head opposite said inner concave;

a pair of clip plates each positioned respectively in said inner concave, each of said pair of clip plates having a convex surface facing said inner concave, each of said pair of clip plates having an aperture at a center thereof, said aperture cantably receiving said bulbous head therein such that said convex surface is spaced a desired distance from said inner concave, each of said pair of clip plates having a plurality of gripping ribs on another surface thereof;

a leaf spring having a spiral section positioned between respective projection pieces of said pair of arms, said leaf spring having a pair of leaf spring arms extending outwardly from said spiral section and along a respective inner surface of said pair of arms; and a bolt extending through the holes of the respective projection pieces, said bolt being secured by a nut thereon such that said pair of arms pivot with respect to each other about said bolt, said leaf spring urging said pair of clip plates toward each other.

* * * * *